US010899158B2

(12) United States Patent
Van Wagoner

(10) Patent No.: US 10,899,158 B2
(45) Date of Patent: Jan. 26, 2021

(54) HINGED REPOSITIONABLE BUSINESS CARD

(71) Applicant: Jon Phillip Van Wagoner, Lake Oswego, OR (US)

(72) Inventor: Jon Phillip Van Wagoner, Lake Oswego, OR (US)

(73) Assignee: Stik Out Cards, LLC, Lake Oswego, OR (US)

( * ) Notice: Subject to any disclaimer, the term of this patent is extended or adjusted under 35 U.S.C. 154(b) by 743 days.

(21) Appl. No.: 14/322,870

(22) Filed: Jul. 2, 2014

(65) Prior Publication Data

US 2015/0007466 A1 Jan. 8, 2015

Related U.S. Application Data

(60) Provisional application No. 61/843,410, filed on Jul. 7, 2013.

(51) Int. Cl.
*B42D 1/00* (2006.01)
*B42D 15/04* (2006.01)
(Continued)

(52) U.S. Cl.
CPC ..... *B42D 1/009* (2013.01); *B42D 1/006* (2013.01); *B42D 1/10* (2013.01); *B42D 5/003* (2013.01);
(Continued)

(58) Field of Classification Search
CPC ..... B42D 15/042
(Continued)

(56) References Cited

U.S. PATENT DOCUMENTS 2,321,184 A 6/1943 Frances
3,290,809 A * 12/1966 King ..... 40/642.01
(Continued)

FOREIGN PATENT DOCUMENTS

CA 2636672 A1 1/2010
CN 201161490 12/2008
(Continued)

OTHER PUBLICATIONS

Chooftech, "Sticky business cards," http://ch00ftech.com/2007/08/31/sticky-business-cards/, Aug. 31, 2007.
(Continued)

*Primary Examiner* — David R Dunn
*Assistant Examiner* — Christopher E Veraa

(57) ABSTRACT

A business card comprises front and back sides and a flap permanently attached to the business card. The flap comprises front and back sides and an adhesive on at least a portion of the flap's back side. The adhesive is capable of removably and reusably adhering to objects. The flap is foldable with respect to the business card such that the flap can be placed in at least two configurations. In a first configuration, the adhesive adheres to a portion of the back side of the business card, so that the business card is non-adhesive and can be used like a convention business card. In a second configuration, the flap aligns at least approximately with the business card, thereby presenting the flap's adhesive to be able to adhere to another object such that the front side of the business card faces outward from said another object.

29 Claims, 5 Drawing Sheets

(51) Int. Cl.

| | |
|---|---|
| ***B42D 1/10*** | (2006.01) |
| ***B42D 5/00*** | (2006.01) |
| ***B42D 15/00*** | (2006.01) |
| ***A45C 11/18*** | (2006.01) |

(52) U.S. Cl.
CPC ..... *B42D 15/0093* (2013.01); *B42D 15/042* (2013.01); *B42D 15/045* (2013.01); *A45C 11/18* (2013.01); *Y10T 156/10* (2015.01)

(58) Field of Classification Search
USPC ..... 40/124.05, 124.09, 638, 661.09
See application file for complete search history.

(56) References Cited

U.S. PATENT DOCUMENTS

| | | | | |
|---|---|---|---|---|
| 4,113,538 | A | 9/1978 | Green | |
| 4,127,690 | A * | 11/1978 | Schleifenbaum et al. | 428/40.1 |
| 4,215,879 | A * | 8/1980 | Blum | 283/81 |
| 4,382,539 | A * | 5/1983 | Kronman | B65D 27/04 206/804 |
| 4,558,980 | A * | 12/1985 | Sturdivan | 412/2 |
| 4,643,452 | A * | 2/1987 | Chang | 283/62 |
| 4,711,347 | A * | 12/1987 | Drexler et al. | 206/38 |
| 4,849,056 | A * | 7/1989 | Ristuccia, Sr. | 402/79 |
| 4,905,392 | A | 3/1990 | Klein | |
| 4,930,234 | A * | 6/1990 | Schmidt | 40/1.5 |
| 4,963,049 | A * | 10/1990 | Pearson | 402/79 |
| 5,016,370 | A | 5/1991 | Rhian et al. | |
| 5,040,216 | A | 8/1991 | Policht | |
| 5,089,337 | A * | 2/1992 | Hochfeld | 428/352 |
| 5,098,129 | A * | 3/1992 | Haber | 283/62 |
| 5,248,164 | A | 9/1993 | Lepretre | |
| 5,318,825 | A * | 6/1994 | Naber | 428/192 |
| 5,329,713 | A * | 7/1994 | Lundell | 40/310 |
| 5,524,998 | A * | 6/1996 | Schwartz | 402/79 |
| 5,575,574 | A * | 11/1996 | Mertens | 400/118.2 |
| 5,683,194 | A * | 11/1997 | Emmel et al. | 402/79 |
| 5,697,518 | A * | 12/1997 | Callahan, Jr. | 221/34 |
| 5,887,899 | A * | 3/1999 | Dobbins | 281/2 |
| 5,924,227 | A * | 7/1999 | Sommers | 40/360 |
| 5,955,166 | A * | 9/1999 | Murphy | 428/40.1 |
| 5,980,676 | A * | 11/1999 | Meetze | 156/216 |
| 6,120,184 | A * | 9/2000 | Laurence | B65D 31/04 383/203 |
| 6,146,728 | A * | 11/2000 | Bay | 428/40.1 |
| 6,179,337 | B1 | 1/2001 | Zumberge | |
| 6,213,519 | B1 | 4/2001 | Bosch | |
| 6,268,032 | B1 | 7/2001 | Mertens et al. | |
| 6,360,465 | B1 * | 3/2002 | Simpson | 40/638 |
| 6,546,657 | B2 * | 4/2003 | Gray | 40/643 |
| 6,719,475 | B2 * | 4/2004 | Arkwright | 402/8 |
| 6,910,667 | B2 | 6/2005 | Mizuno | |
| 7,086,559 | B2 | 8/2006 | Poole | |
| 7,124,524 | B2 * | 10/2006 | Valenti, Jr. | 40/27 |
| 7,225,570 | B2 * | 6/2007 | Windorski | 40/641 |
| 7,437,994 | B1 | 10/2008 | Ratzloff | |
| 7,857,130 | B2 | 12/2010 | Bartusiak | |
| 7,883,115 | B2 | 2/2011 | Keefe | |
| 8,225,717 | B2 | 7/2012 | Ratzloff | |
| 8,381,648 | B2 | 2/2013 | Ratzloff | |
| 8,474,165 | B1 | 7/2013 | Hill | |
| 8,656,616 | B2 | 2/2014 | Ashpole et al. | |
| 2002/0079691 | A1 * | 6/2002 | Zumberge | 283/81 |
| 2002/0089171 | A1 * | 7/2002 | Silvestre | 283/61 |
| 2002/0119273 | A1 | 8/2002 | Napierala | |
| 2004/0093772 | A1 * | 5/2004 | Gottlieb et al. | 40/124.05 |
| 2004/0174010 | A1 * | 9/2004 | McGuiness | 283/56 |
| 2005/0191455 | A1 | 9/2005 | Hsu | |
| 2005/0193608 | A1 * | 9/2005 | Flynn et al. | 40/638 |
| 2006/0057324 | A1 | 3/2006 | Phillips et al. | |
| 2006/0107576 | A1 * | 5/2006 | Hirst | 40/638 |
| 2007/0180746 | A1 * | 8/2007 | Von Ohsen | 40/638 |
| 2007/0200336 | A1 * | 8/2007 | Wilen | 283/74 |
| 2008/0063842 | A1 | 3/2008 | Callinan et al. | |
| 2009/0278343 | A1 | 11/2009 | Fischer | |
| 2011/0072701 | A1 * | 3/2011 | Lemna | 40/638 |
| 2013/0192112 | A1 * | 8/2013 | Yamamuro et al. | 40/638 |
| 2013/0240134 | A1 * | 9/2013 | Flynn et al. | 156/227 |
| 2015/0014982 | A1 | 1/2015 | Van Wagoner | |

FOREIGN PATENT DOCUMENTS

| | | | |
|---|---|---|---|
| DE | 8415028 | U1 | 10/1984 |
| DE | 4418923 | A1 | 12/1995 |
| DE | 29518816 | U1 | 5/1996 |
| DE | 19844798 | A1 | 6/1999 |
| EP | 0638441 | B1 | 3/1998 |
| EP | 1144202 | B1 | 7/2003 |
| FR | 2674794 | A1 | 7/2003 |
| FR | 2839009 | A1 | 10/2003 |
| GB | 332119 | | 7/1930 |
| GB | 2462324 | | 2/2010 |
| JP | 2001063250 | A | 3/2001 |
| JP | 3144503 | U | 9/2008 |
| JP | 2013046976 | | 3/2013 |
| KR | 20090007448 | U | 7/2009 |
| SE | 531560 | | 5/2009 |
| WO | 2003064172 | A1 | 8/2003 |

OTHER PUBLICATIONS

Footprints, "Sticky Full Colour Business Cards," 2012.
J. Van Wagoner, U.S. Appl. No. 14/322,875, "Two-Sided Hinged Repositionable Note," filed Jul. 2, 2014.
Mimi Hager, Feb. 24, 20012, http://5thgraderocks5thgraderules.blogspot.com/2012/02/posting-plurals.html.
RPM Products, "Business Cards, Peel & Stick, 1 Ink Color [BC-PS1]," http://rpmco.com/store/business-cards-peel-stick-color-p-56107009.html?osCsid=51974f114ad9e61a4447ed0859f4c543, Date Unknown.
RPM Products, "Business Cards, Peel & Stick, Black Ink [BC-PS]," http://rpmco.com/store/business-cards-peel-stick-black-p-56107008.html?osCsid=51974f114ad9e61a4447ed0859f4c543, Date Unknown.
Skott Chun, "Fedrigoni 2010 Calendar by Studio8," http://www.designyearbook.com/2009/12/fedrigoni-2010-calendar-by-studio8.html.
Smartpractice, "Full Color, Custom and Die Cut ReStix™," http://www.smartpractice.com/Apps/WebObjects/SmartPractice.woa/wa/category?cn=Promotional-Giveaways-ReStix%26trade%3B-Full-Color&id=407125&m=SPM, Date Unknown.
Non-Final Office Action dated Mar. 7, 2017 in U.S. Appl. No. 14/322,875.
Response filed Jul. 7, 2017 in U.S. Appl. No. 14/322,875.
Decl. of Jon P. Van Wagoner filed Jul. 7, 2017 in U.S. Appl. No. 14/322,875.
Notice of Allowance dated Aug. 17, 2017 in U.S. Appl. No. 14/322,875.
Final Office Action in U.S. Appl. No. 16/557,104, dated Jun. 5, 2020.
Response to Office Action in U.S. Appl. No. 16/557,104, filed Sep. 8, 2020.
Non-Final Office Action dated Jul. 23, 2018 in U.S. Appl. No. 15/852,485.
Final Office Action dated Dec. 21, 2018 in U.S. Appl. No. 15/852,485.
After-Final Office Action Response dated Feb. 21, 2019 in U.S Appl. No. 15/852,485.
Advisory Action dated Mar. 7, 2019 in U.S. Appl. No. 15/852,485.
Response to Advisory Action dated Mar. 13, 2019 in U.S. Appl. No. 15/852,485.
Non-Final Office Action dated Feb. 27, 2020 in U.S. Appl. No. 16/557,104.
Response to Non-Final Office Action dated Feb. 27, 2020, filed May 27, 2020, in U.S. Appl. No. 16/557,104.

* cited by examiner

HINGED REPOSITIONABLE BUSINESS CARD

RELATED APPLICATIONS

This application claims priority under 35 U.S.C. § 119(e) to U.S. Provisional Patent Application No. 61/843,410, entitled "Two-Sided Hinged Repositionable Note," filed Jul. 7, 2013. The entire disclosure of that provisional patent application is incorporated by reference herein, and attention is drawn specifically to pages 18-19 and FIGS. 13-15 of that provisional patent application.

This application is also related to U.S. patent application Ser. No. 14/322,875, entitled "Two-Sided Hinged Repositionable Note," filed Jul. 2, 2014, the entire disclosure of which is incorporated by reference herein. The teachings and disclosure set forth in that patent application regarding a "note" are applicable to the case wherein the note is a business card.

TECHNICAL FIELD

The field of this disclosure relates generally to business cards and more particularly to a business card with a selectively exposable and re-exposable adhesive flap designed for removably attaching the business card to other objects.

BACKGROUND INFORMATION

Business cards are ubiquitous in today's society as a means to inform or remind people about a person, business, or other organization, or to convey a message or other information. The typical business card includes a person's name and contact information and possibly other information about the person or his or her business. Business cards are used in almost all professions to facilitate actual and prospective customers or clients to contact a business person when the need arises. A business card also serves as a convenient reminder of how to contact a person.

Business cards are usually rectangular in shape and typically 3.5" by 2" in size. A business card is usually made of paper, typically card stock of sufficient thickness to be durable and to have sufficient rigidity to maintain its shape. Business cards may have indicia on only one side, or both. The indicia may be printed or generated by other means. The base card may be white or colored, and the indicia may be monochromatic or polychromatic. The indicia may be limited to text or may optionally include graphics, such as, for example, a logo. More recently, some business cards have begun including two-dimensional optical codes, such as a QR® code, that encode information about the person. For example, an optical code may encode a hyperlink to a website of the person or his or her business.

One shortcoming with conventional business cards is that they are small loose articles that can easily be lost or separated from other items with which they are or should be associated. For example, a business card provided to a customer or prospective customer along with promotional items may get separated from those items. Even if the person's contact information is elsewhere on the promotional items, it can be inconvenient for someone to have to search for that information when the business card cannot be readily located. Moreover, a business card placed on a desk, near a phone, or another convenient place can easily get lost or covered by other papers or other items and is therefore not as useful as a card that remains in clear view where it was placed. An adherable business card can avoid those shortcomings.

Business cards with an adhesive on all or part of its back side are known. However, the utility of such cards is limited. If the adhesive area is covered by a removable backing, it is generally not possible to re-apply the backing over the adhesive after the backing has been removed. Due to that technical flaw, such cards cannot readily be used as a traditional business card after being adhered to another object. They become stickers that formerly were, but never again will be, business cards. It is also known to employ permanent adhesives on business cards, however a permanent adhesive prevents the card from being removed—and therefore being used as a business card again—once it is adhered. Such cards also become nothing more than a sticker incapable of ever being used again as a business card.

OVERVIEW OF DISCLOSURE

This patent document discloses various business cards with the ability to be repeatedly configured to adhere to a surface of another object and then returned to a configuration in which the card has no exposed adhesive and can be used as a traditional business card.

According to one embodiment, a business card comprises a front side, a back side opposite the front side, and a flap permanently attached to the business card. The flap comprises a front side, a back side opposite the front side of the flap, and an adhesive on at least a portion of the back side of the flap. The adhesive is capable of removably and reusably adhering to objects. The flap is foldable with respect to the business card such that the flap can be placed in at least two configurations. In a first configuration, the adhesive on the back side of the flap adheres to a portion of the back side of the business card. In a second configuration, the flap aligns at least approximately with the business card such that the front of the business card and the front of the flap face the same general forward direction, and the back of the business card and the back of the flap face the same general direction that is generally opposite the forward direction, thereby presenting the flap's adhesive to be able to adhere to another object such that the front side of the business card faces outward from said another object.

Optionally, the business card may have a form of a conventional business card and/or have no exposed adhesive in the first configuration. Optionally, the business card may be substantially flat against said another object in the second configuration.

Optionally, the flap can be placed in a third configuration wherein the flap's adhesive is able to adhere to said another object, and the business card is further pivoted with respect to the flap such that the front side of the business card faces the front side of the flap, thereby exposing the back side of the business card outward from said another object.

Optionally, the flap attaches to the business card along a periphery edge of the business card, the flap extends across substantially the entire length of the business card, the flap has an area that is between about 10% and about 33% of an area of the business card, and/or the portion of the back side of the flap on which there is adhesive is less than the entire area of the back side of the flap.

Optionally, the back side of the flap has no adhesive in a lengthwise central area of the flap. The lengthwise central area may be configured to permit an object to fit between the back side of the flap and the back side of the business card in the first configuration to facilitate unsticking the flap from the business card so as to move the flap toward the second configuration. The object fitting between the back side of the flap and the back side of the business card may be a person's thumb or finger.

Optionally, the flap may be a plastic, such as a polyvinylidene chloride; the flap may be more flexible than the non-flap portion of the business card; the flap may be sufficiently flexible such that the business card is operable to pivot readily approximately 180° relative to the flap in response to manual force from a finger of a person or blowing by a person.

Optionally, the adhesive has a tackiness sufficiently weak to be overcome manually to remove the business card from the surface of said another object, and wherein the adhesive is sufficiently persistent after removal to reapply the business card to the same or different surface. The adhesive may be a pressure-activated adhesive.

Optionally, the flap may comprise a portion of a piece of a plastic; double-sided tape, a first side of which is adhered to the portion of a first side of the piece of the plastic sheet; and talc on a portion of a second side of the double-sided tape. The second side of another portion of the piece of the plastic sheet may be secured to the back side of the business card with a permanent adhesive.

According to another embodiment, a business card is changeable between an adhesive configuration and non-adhesive configuration. The business card comprises a generally flat business card body having opposing front and back sides and a flap permanently attached to the generally flat business card body. The flap has an adhesive side an opposing non-adhesive side. The adhesive side of the flap has an adhesive area that is adherable to, removable from, and re-adherable to another object. The flap is moveable from a first position to a second position. In the first position, the flap is folded against the business card body such that the adhesive side of the flap adheres to the back side of the business card body. In the second position, the flap exposes the adhesive area to permit the business card to adhere to another object.

Optionally, the business card body has a form of a conventional business card and no part of the adhesive area is exposed when the flap is in the first position.

Optionally, the flap can be placed in a third position wherein the flap's adhesive is able to adhere to said another object, and the business card body is further pivoted with respect to the flap such that the front side of the business card body faces the front side of the flap, thereby exposing the back side of the business card body outward from said another object.

Optionally, the adhesive area does not include a portion of the adhesive side of the flap where an object can fit between the business card body and the adhesive side of the flap in the first position to facilitate unsticking the flap from the business card body so as to move the flap toward the second position.

Optionally, the flap is substantially transparent and/or more flexible than the business card body.

Optionally, the business card further comprises a joint portion between the business card body and the flap. The joint portion may rotate approximately 360°.

According to another embodiment, the business card has a flap, preferably placed along all or part of one edge of the card. The flap has an adhesive on one side for adhering to a surface of another object. The flap attaches to the body of the business card with or at a hinge, articulating joint, fold or the like. The flap may be folded down substantially flat against the body of the business card to cover the flap's adhesive against the business card, thereby resulting in a non-sticky business card that can be used like a traditional business card. When one desires to stick the business card to another object, the flap can be unhinged from the body of the business card and pivoted about its hinge or joint to expose its adhesive, which can then be adhered to a desired object.

According to another embodiment, the business card has an exposable and re-exposable strip of adhesive on the back of the card, preferably near to and along one edge of the card. The business card may feature a removable cover attached to a hinge, articulating joint, fold or the like near the edge along which the adhesive strip is placed. The removable cover can cover and uncover the adhesive strip so as to the convert the business card from an adherable configuration to a non-adherable configuration like a traditional business card.

According to yet another embodiment, a business card comprises a means for displaying business information and a means for converting the means for displaying business information from an adhesive configuration to a non-adhesive configuration and vice versa. The means for displaying business information may be a conventional business card. The means for converting the means for displaying business information from an adhesive configuration to a non-adhesive configuration and vice versa may be a flap permanently attached to the business card as described herein. The flap has a removable and re-adherable adhesive on one side, such that the flap can be folded against and adhered to the business card, thereby resulting in the non-adhesive configuration. When the adhesive side of the flap is detached from the business card body and extended out from the business card body, the flap may be attached to another object, thereby resulting in the adhesive configuration. Because the adhesive on the flap is removable and re-adherable, the business card can be converted from one configuration to the other and back again over and over.

Another aspect of the invention is a method of using a selectively adhesive business card. The method comprises storing the business card in a non-adhesive form such that an adhesive flap of the business card is folded down against and adheres to a portion of the business card, unsticking the flap from the portion of the business card, sticking the adhesive flap to another object to thereby adhere the business card to said another object, removing the adhesive flap from said another object, and re-sticking the adhesive flap to the portion of the business card to thereby return the business card to the non-adhesive form.

Another aspect of the invention is a selectively adhesive business card product made by a process. The process comprises permanently attaching to a business card a portion of one side of a plastic sheet, thereby creating an attached portion of the plastic sheet and a free portion of the plastic sheet, and adhering a first side of double-sided tape to at least a part of the free portion of the plastic sheet on a side of the plastic sheet opposite said one side of the plastic sheet.

Optionally, the step of permanently attaching to a business card a portion of one side of a plastic sheet may further comprise applying permanent adhesive to a section of a back side of the business card and attaching said one side of the attached portion of the plastic sheet to the permanent adhesive on the back side of the business card.

Optionally, the process may further comprise applying an anti-tackiness substance to substantially the entire attached portion of the plastic sheet on the side of the plastic sheet opposite said one side of the plastic sheet and applying an anti-tackiness substance to a portion of the second side of the double sided tape.

As one skilled in the art will appreciate in light of this disclosure, certain embodiments may be capable of achieving certain advantages, including, in some cases, some or all of the following: (1) enabling a business card to be attached to a desired object; (2) enabling a business card to be fixedly placed in a desired location; (3) reducing the risk of loss of a business card; (4) increasing the likelihood that the business card will be used; (5) providing a business card that can be easily converted into a non-sticky form suitable for all uses of a traditional business card; (6) providing a business card that can be repeatedly converted between a sticky form and a non-sticky form many times; (7) providing a business card that can be easily converted into a sticky form by, for example, placing a thumb or other object in a convenient lift pocket to hold and detach a sticky flap from the body of the card; (8) providing a business card that can be easily turned to reveal its back side while adhered to an object; and (9) providing a business card that is more distinctive than business cards that do not have the inventive features disclosed herein. The following paragraphs elaborate on some of these and other advantages:

DETAILED DESCRIPTION OF EMBODIMENTS

With reference to the above-listed drawings, this section describes particular embodiments and their detailed construction and operation. The embodiments described herein are merely examples, set forth by way of illustration only and not limitation. Those skilled in the art will recognize in light of the teachings herein that there are alternatives, variations and equivalents to the example embodiments described herein. For example, other embodiments are readily possible, variations can be made to the embodiments described herein, and there may be equivalents to the components, parts, or steps that make up the described embodiments.

For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

FIGS. 1-4 illustrate an example of a business card 100 according to one embodiment of the invention. The business card 100 comprises a business card body 120 and an anchor portion or flap 140. A top edge 160 of the business card body 120 is where the flap 140 attaches to the business card body 120. The top edge 160 may be the place of the flap's joint or hinge with respect to the business card body 120.

Figure 2:
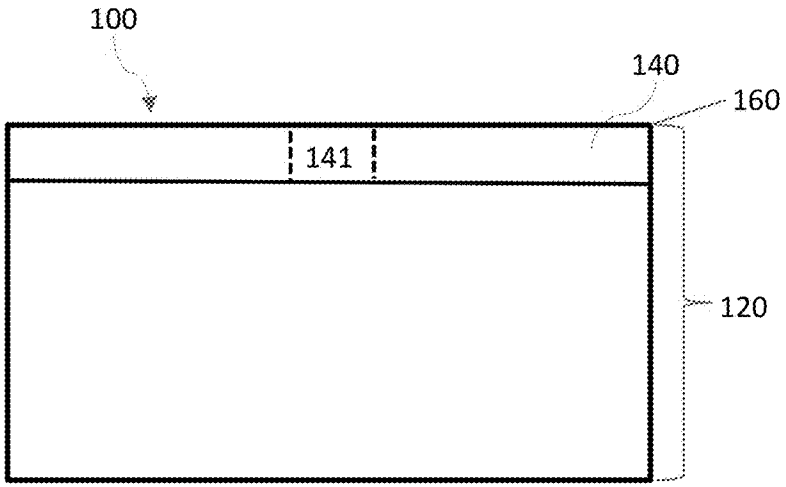
FIG. 2 is a back view of the business card of FIG. 1 in the first configuration.
Figure 1:
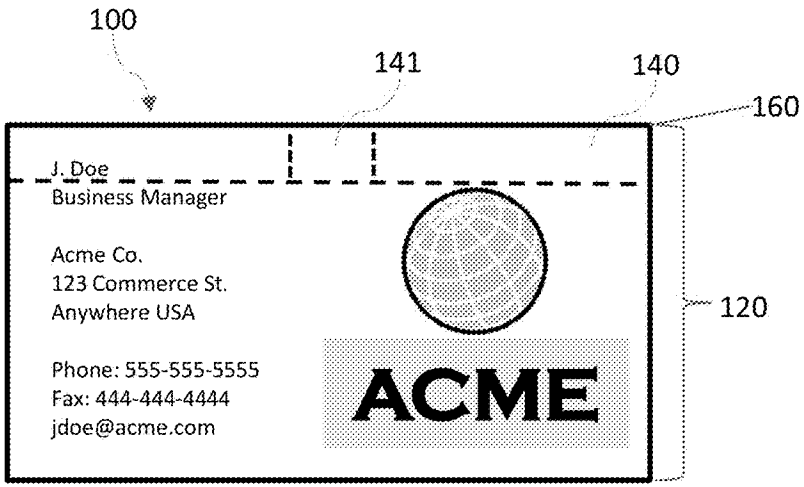
FIG. 1 is a front view of a business card in a first configuration, according to one embodiment.

FIGS. 1 and 2 are respective front and back views of a business card 100 in first, folded, or non-adhesive configuration, such that the flap 140 is folded behind the business card body 120. If the user desires not to have the flap 140 protrude from the business card 100, e.g., for uses such as filing the card in a filing system like a ROLADEX™, placing in a wallet or pocket, etc., the user can utilize the business card 100 in this first configuration. If necessary, the business card 100 can be readily converted into this first configuration by folding the flap 140 down and adhering it to the back of the business card body 120.

Figure 4:
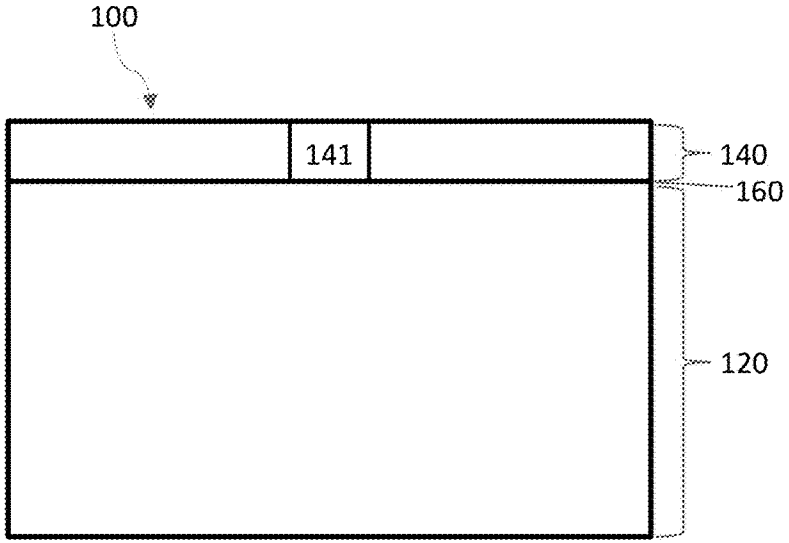
FIG. 4 is a back view of the business card of FIGS. 1 and 2 in a second configuration.
Figure 3:
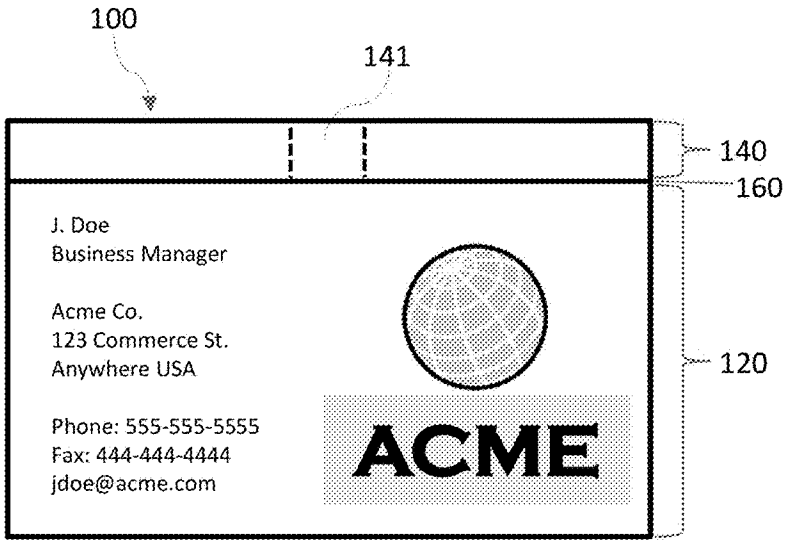
FIG. 3 is a front view of the business card of FIGS. 1 and 2 in a second configuration.

FIG. 3 is a front view of the business card 100 in a second, unfolded or adhesive configuration, and FIG. 4 is a back view of the business card 100 in the second configuration. In this second configuration, the sticky side of the flap 140 may be either the front side or the back side, preferably the back side. The flap 140 optionally may include a "lift pocket" section 141 that has little or no adhesive, as shown. The lift pocket 141 may serve as a thumb or finger hold to assist in removing the business card 100 from a foreign object or from the back side of the business card body 120. The business card 100 in this example may provide a valuable way for an individual to stick the business card 100 on a wall, computer, desk, car, promotional literature, etc. so that the information on the business card 100 is always visible for quick access. Using the lift pocket 141 in the middle or other section of the flap 140, the user can place the tip of a finger or small object into this section and unstick the flap 140 completely from the back of the business card 100 and virtually convert it back to an adhesive configuration (i.e., a sticky or stickable business card). In one example embodiment, the lift pocket 141 is approximately 0.75" wide. The business card 100 could be provided initially with the sticky strip stuck to the back. Such a business card 100 eliminates the need to otherwise secure the business card to a convenient place using tape or the like. One or more lift pockets, release zones, or non-adhesive areas may be incorporated into any other version of a business card.

Figure 7:
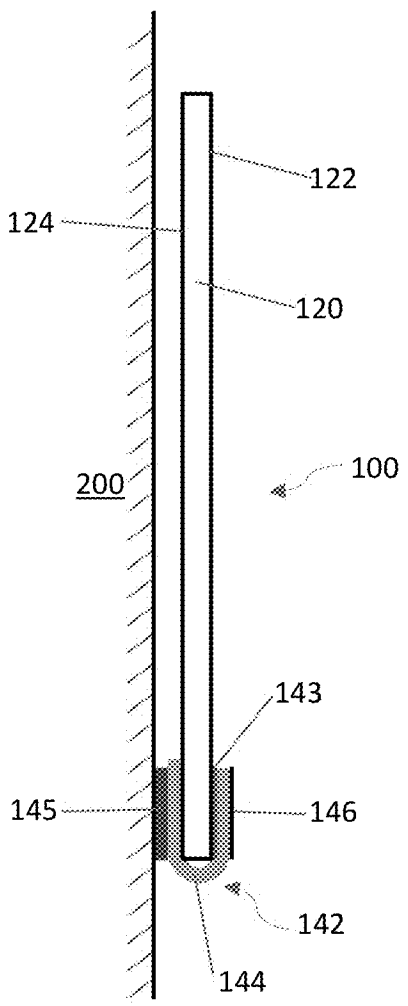
FIG. 7 is a side view of the business card of FIGS. 1-4 in a third configuration.
Figure 6:
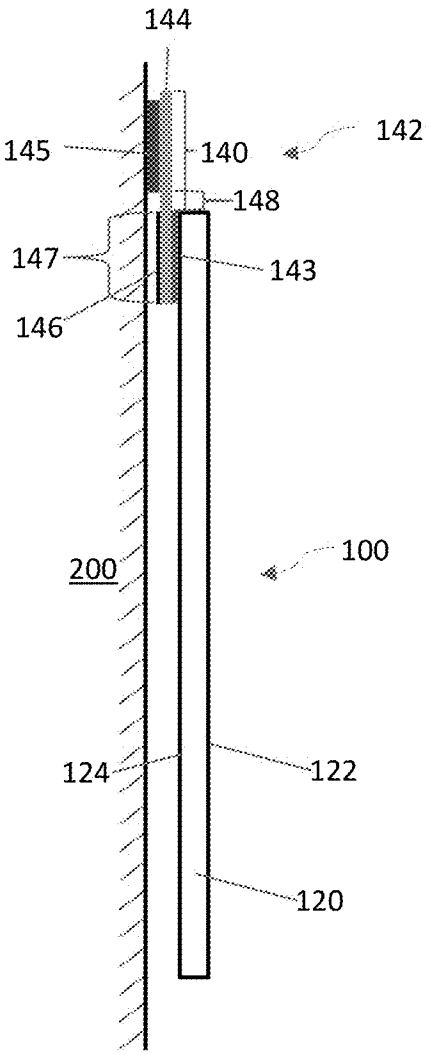
FIG. 6 is a side view of the business card of FIGS. 1-4 in a second configuration.
Figure 5:
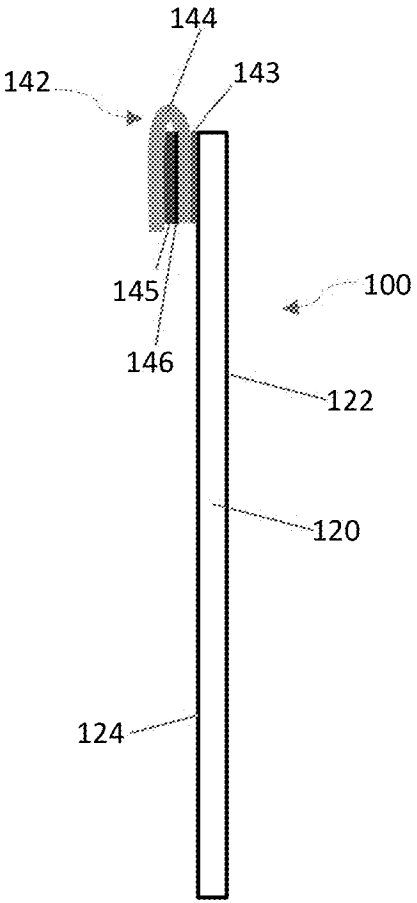
FIG. 5 is a side view of the business card of FIGS. 1-4 in a first configuration.

FIGS. 5-7 are side views of an example of the business card 100 in three different configurations, respectively, according to one embodiment. FIGS. 5-7 illustrate an example of one construction of a flap 140 and its attachment to the body 120 of the business card 100. Parts of the flap 140 in FIGS. 5-7 are exaggerated in scale to better illustrate those features. FIGS. 5-7 are not drawn to scale.

FIG. 5 shows a first, folded, or non-adhesive configuration of the business card 100. FIG. 6 shows a second, unfolded, or adhesive configuration. FIG. 7 shows a third configuration, in which the business card 100 is also adhesive but turned upside down to reveal the back of the business card body 120. The flap 140 rotates approximately 180° with respect to the business card body 120 in moving from the first to the second configuration and another 180° approximately in moving from the second to the third configurations. Thus, but for the thickness of the business card body 120, which is typically negligible, the flap 140 is able to rotate approximately 360° with respect to the business card body 120.

The business card body 120 has a front side 122 and a back side 124. The flap 140 is part of a flap assembly 142 according to this embodiment. The flap assembly 142 comprises a flexible (e.g., plastic) member 144, which is permanently adhered to the back side 124 of the business card body 120 by a thin layer of permanent adhesive 143, which, as shown, goes along the top edge of the business card body 120. Alternatively, the flap assembly 142 may be located along another edge (e.g., bottom or side) of the business card body 120, or in the interior of the business card body 120 (i.e., not along a periphery edge).

In addition to the permanent adhesive 143 and the flexible member 144, the flap assembly 142, according to this embodiment, comprises a removable/re-adherable adhesive 145, and an anti-tackiness coating 146. As shown in the second and third configurations depicted in FIGS. 6 and 7, the removable/re-adherable adhesive 145 attaches the business card 100 to another object 200. With reference to FIG. 6, the flap assembly 142 can be seen to have a base portion 147, a hinge or joint portion 148, and a free portion, which is the flap 140 proper. The flap assembly 142, the flexible member 144, and the flap 140 each have a front side, which as shown in FIG. 6 faces the same direction as the front side 122 of the business card body 120, and an opposite back side, which faces left as shown in FIG. 6, like the back side of the business card body 120. The front side of the flexible member 144 base is permanently attached to the back side 124 of the business card body 120 in the base area 147. The removable/re-adherable adhesive 145 is attached to the back side of the flexible member 144 in part of the free portion. The base area generally does not overlap with the portion of the flap 140 where the back side has the removable/re-adherable adhesive 145.

An area above the base portion 147 and below the removable/re-adherable adhesive 145, as shown in FIG. 6, is the hinge 148. The hinge is the part of the flap assembly 142 that is thinnest and therefore weakest and most easily deflected. The flap 140 can rotate about the business card body 120 to convert between the first configuration (e.g., FIG. 5) and the second configuration (e.g., FIG. 6). The business card body 120 can rotate about the flap 140 to convert between the second configuration (e.g., FIG. 6) and the third configuration (e.g., FIG. 7). The hinge 148 should have sufficient height to permit those rotations, which total almost 360°. Because of the ease of deflection of the hinge 148, the business card body 120 can be easily turned over (e.g., from FIG. 6 to FIG. 7) with a light touch or even blowing. If the business card 100 is mounted to door or other rotating object, the rotation of the door can create sufficient force to cause the business card 100 to turn over. Thus, the business card 100 can be attached, for example, inside a cupboard door, such that opening of the cupboard door causes the business card 100 to turn over and draw attention to the business card 100. If, for example, a sink or other plumbing is behind the cupboard door, a plumber may wish to leave his or her business card 100 on the inside of that cupboard door.

A portion of the back side 124 of the flap assembly 142 may be coated with the anti-tackiness coating 146. The anti-tackiness coating 146 may be positioned on the back side of the base portion 147 of the flap assembly 142 so that when the flap 140 is folded down on itself, the removable/re-adherable adhesive 145 contacts the anti-tackiness coating 146, as shown in the first configuration in FIG. 5. The purpose of the anti-tackiness coating 146 is to limit the strength of adhesion between the removable/re-adherable adhesive 145 and the anti-tackiness coating 146 to facilitate easy release and unfolding of the flap 140 to convert from the first configuration to the second configuration.

The flexible member 144 may be a plastic, for example, a polyvinylidene chloride. An example of a suitable material for the flexible member 144 is Saran® sheet or film. The permanent adhesive 143 may be any adhesive or glue suitable for permanently attaching paper or cardstock—as those are the typical materials from which business cards are made—to the flexible member 144. An example of a suitable adhesive 143 is 3M® Supper 77® spray-on adhesive.

The removable/re-adherable adhesive 145 may be, for example, double-sided tape, which adheres well to the flexible member 144 and attaches sufficiently strong but yet can readily be removed from most surfaces, especially smooth surfaces. The adhesion strength of the removable/re-adherable adhesive 145 to a foreign object should be less that the adhesion strength between the removable/re-adherable adhesive 145 and the flexible member 144 and also less than the adhesion strength of the permanent adhesive 143, preferably considerably less. That way, pulling the business card body 120 right from the position shown in FIGS. 6 and 7 will cause the removable/re-adherable adhesive 145 to detach from the object 200 before, preferably well before, any of the other adhesive bonds release and before any part of the business card 100 structurally fails.

The anti-tackiness coating 146 may be, for example, talc. The anti-tackiness coating 146 is preferably applied to a strip-shaped portion of the flap 140 along the entire length of the business card 100. As noted above, the purpose of the anti-tackiness coating 146 is to limit the strength of adhesion between the removable/re-adherable adhesive 145 and the anti-tackiness coating 146 to facilitate easy release and unfolding of the flap 140 to convert from the first configuration to the second configuration. If the removable/re-adherable adhesive 145 and the flexible material 144 are such that their adhesion is inherently limited to a sufficient extent, then the anti-tackiness coating 146 can be omitted. An anti-tackiness coating may also be applied to a portion of the removable/re-adherable adhesive 145 to create the lift pocket 141, as explained elsewhere in this document.

One or more of the permanent adhesive 143, the flexible member 144, the removable/re-adherable adhesive 145, and the anti-tackiness coating may be wholly, substantially, or partly transparent.

Figure 8:
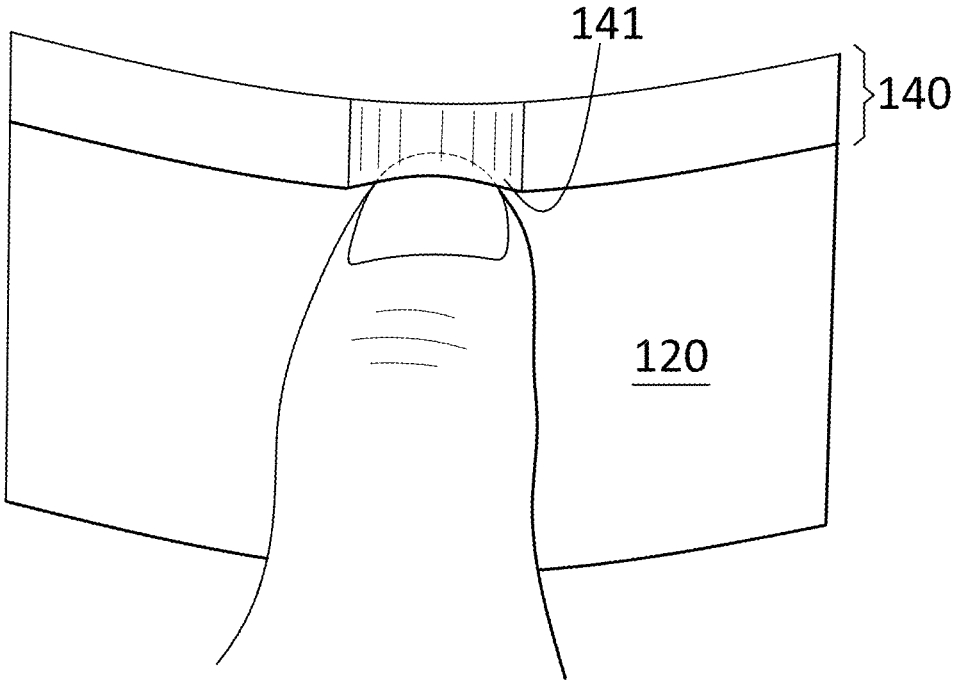
FIG. 8 is an illustration of use of a thumb in a lift pocket of a business card according to one embodiment.

FIG. 8 is a perspective view of an example of the business card 100, showing its back side in the first configuration (i.e., as depicted in FIGS. 1, 2 and 5), with a person's thumb in position to utilize the lift pocket 141 to release, lift, and unfold the flap 140 to move it toward the second configuration (i.e., as depicted in FIGS. 3, 4 and 6). The lift pocket 141 is an area with less adhesive, possibly no adhesive, on the back side of the flap 140. Bending the sides of the business card body 120 up, as shown in FIG. 8, can help open the lift pocket 141 slightly to facilitate entry of a thumbnail or other object (e.g., coin or pen or pencil tip) into the lift pocket 141. In other words, bending the sides of the business card body 120 up, when the card is face down, can create separation between the back of the business card body 120 and the flap 140 in the area of the lift pocket 141.

Figure 9A:
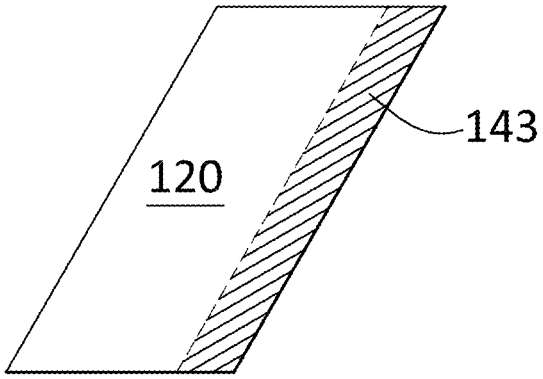
FIGS. 9A-9D are perspective views of different stages of construction of a business card according to one embodiment.
Figure 9B:
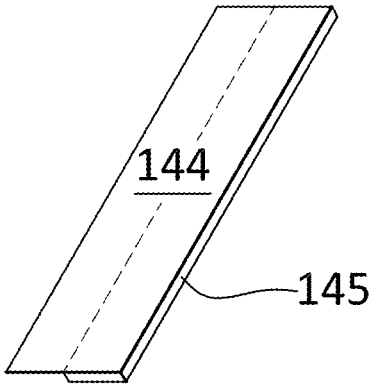
Figure 9C:
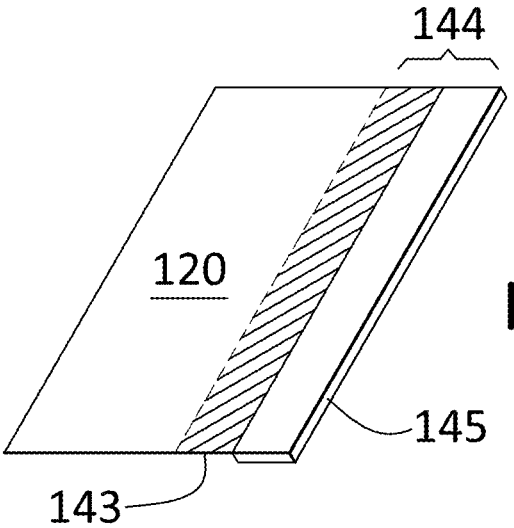
Figure 9D:
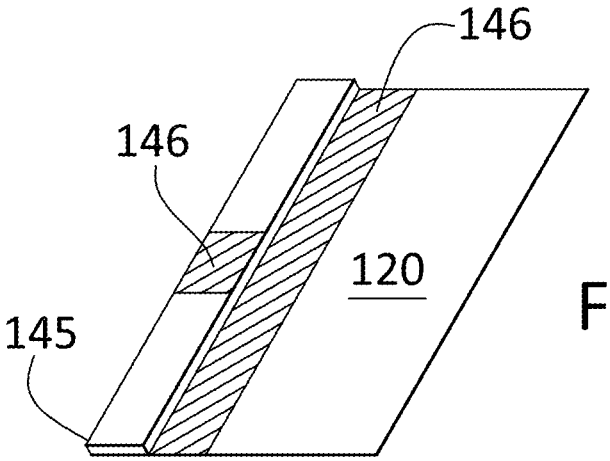

FIGS. 9A-9D are diagrams showing a sequence of steps to construct one example of the business card 100. FIG. 9A shows a business card body 120, which may be a conventional business card, with permanent adhesive 143 on an area of the back side. In this case, that area is along the top edge of the business card body 120. FIG. 9B shows a flap 140 in a state of partial construction. Specifically, the flap 140 in FIG. 9B includes a flexible sheet 144, a portion of which on one side is attached to an adhesive layer 145, the bottom side of which (as shown) is removable and re-adherable. The adhesive layer 145 may be a strip of double-sided tape. The partially constructed flap 140 shown in FIG. 9B may be made before or after the permanent adhesive 143 is applied to the back side of the conventional business card, as shown in FIG. 9A. FIG. 9C shows the parts of FIGS. 9A and 9B together such that the flap 140 is attached to the business card body 120 by means of the permanent adhesive 143. Alternatively, the flexible sheet 144 may be attached to the business card body 120 before the adhesive layer 145 is attached to the flexible sheet 144. FIG. 9D shows the assembled business card of FIG. 9C turned over and with an anti-tackiness coating 146 applied (1) on a portion of the flexible sheet 144 on the opposite side where the flexible sheet 144 is attached to the business card body 120 and (2) over a portion of the adhesive layer 145 where the lift pocket 141 is desired.

Figure 10:
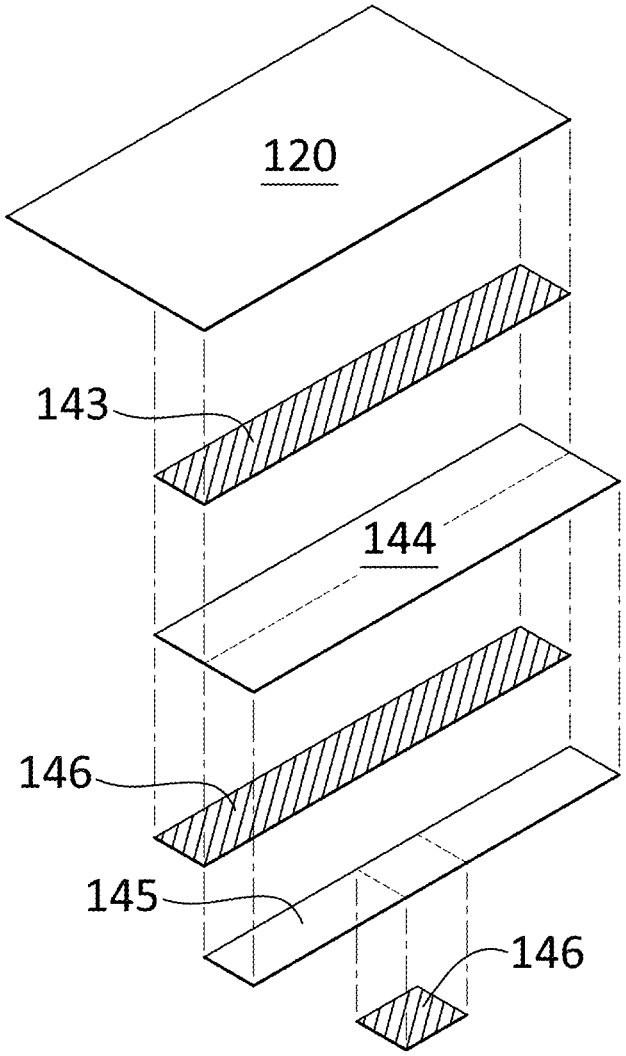
FIG. 10 is an exploded view of a business card constructed according to FIGS. 9A-9D.

FIG. 10 is an exploded diagram of one example of the business card 100 showing the various layers that result from the construction depicted in FIGS. 9A-9D. In general, any method for assembling the parts shown in FIG. 10, in any order, may be employed.

CONCLUSION

The terms and descriptions used above are set forth by way of illustration and example only and are not meant as limitations. Those skilled in the art will recognize that many variations, enhancements and modifications of the concepts described herein are possible without departing from the underlying principles of the invention. For example, although the examples presented above pertain to a business card, the same concepts and technology may be applied to any type of card, including, for example, greeting cards, holiday cards, postcards, recipe cards, flashcards, photograph prints, coupons, etc. The scope of the invention should therefore be determined only by the following claims, claims presented in a continuation patent application, and equivalents to the foregoing claims.

The invention claimed is:

1. A business card comprising:

a front side;

a back side opposite the front side;

four edges; and a non-removable flap permanently attached to the business card along substantially the entire length of one of the four edges, the flap comprising:

a front side;

a back side opposite the front side of the flap; and an adhesive on at least a portion of the back side of the flap, wherein the adhesive is capable of removably and reusably adhering to objects, the flap being foldable with respect to the business card such that the flap can be alternately and repeatedly placed in the following two configurations:

a first configuration wherein the adhesive on the back side of the flap adheres to a portion of the back side of the business card, and a second configuration wherein the flap aligns at least approximately with the business card such that the front of the business card and the front of the flap face the same general forward direction, and the back of the business card and the back of the flap face the same general direction that is generally opposite the forward direction, thereby presenting the flap's adhesive to be able to adhere to another object such that the front side of the business card faces outward from said another object, wherein the back side of the flap has a lengthwise central area in which there is no adhesive anywhere along the height of the flap.

2. A business card according to claim 1, wherein the business card has a form of a conventional business card in the first configuration.

3. A business card according to claim 1, wherein no adhesive is exposed in the first configuration.

4. A business card according to claim 1, wherein the business card is flat against said another object in the second configuration.

5. A business card according to claim 1, wherein the flap can be placed in a third configuration wherein the flap's adhesive is able to adhere to said another object, and the third configuration is further characterized in that the business card is further pivoted with respect to the flap such that the front side of the business card faces the front side of the flap, thereby exposing the back side of the business card outward from said another object.

6. A business card according to claim 1, wherein the flap attaches to the business card along a periphery edge of the business card.

7. A business card according to claim 1, wherein in the flap extends across substantially the entire length of the business card.

8. A business card according to claim 1, wherein the flap has an area that is between about 10% and about 33% of an area of the business card.

9. A business card according to claim 1, wherein the lengthwise central area is configured to permit an object to fit between the back side of the flap and the back side of the business card in the first configuration to facilitate unsticking the flap from the business card so as to move the flap toward the second configuration.

10. A business card according to claim 9, wherein said object fitting between the back side of the flap and the back side of the business card is a person's thumb or finger.

11. A business card according to claim 1, wherein the flap is a plastic.

12. A business card according to claim 11, wherein the plastic is a polyvinylidene chloride.

13. A business card according to claim 1, wherein the flap is more flexible than the non-flap portion of the business card.

14. A business card according to claim 1, wherein the flap is sufficiently flexible such that the business card is operable to pivot readily approximately 180° relative to the flap in response to manual force from a finger of a person.

15. A business card according to claim 1, wherein the adhesive has a tackiness sufficiently weak to be overcome manually to remove the business card from the surface of said another object, and wherein the adhesive is sufficiently persistent after removal to reapply the business card to the same or different surface.

16. A business card according to claim 1, wherein the adhesive is a pressure-activated adhesive.

17. A business card according to claim 1, wherein the flap comprises:

a portion of a piece of a plastic sheet;

double-sided tape, a first side of which is adhered to the portion of a first side of the piece of the plastic sheet; and talc on a portion of second side of the double-sided tape, and wherein the second side of another portion of the piece of the plastic sheet is secured to the back side of the business card with a permanent adhesive.

18. A business card changeable between an adhesive configuration and non-adhesive configuration, the business card comprising:

a generally flat paper business card body having opposing front and back sides; and a non-removable plastic flap permanently attached to the generally flat paper business card body, the plastic flap having an adhesive side and an opposing non-adhesive side, the adhesive side of the plastic flap having an adhesive area that is adherable to, removable from, and re-adherable to another object, the plastic flap being moveable from a first position to a second position, wherein the plastic flap in the first position is folded against the paper business card body such that the adhesive side of the plastic flap adheres to the back side of the paper business card body, and wherein the plastic flap in the second position exposes the adhesive area to permit the business card to adhere to another object, and wherein the plastic flap can be placed in a third position wherein the plastic flap's adhesive is able to adhere to said another object, and the third position is further characterized in that the paper business card body is further able to pivot with respect to the plastic flap such that the back side of the paper business card body is exposed outward from said another object, and wherein the paper business card body lies flat against said another object.

19. A business card according to claim 18, wherein the paper business card body has a form of a conventional business card and no part of the adhesive area is exposed when the plastic flap is in the first position.

20. A business card according to claim 18, wherein the adhesive area includes at least two non-contiguous portions, thereby defining a non-adhesive portion of the adhesive side of the flap, the non-adhesive portion being between two non-contiguous portions of the adhesive area, the non-adhesive portion being sized such that an object can fit between the paper business card body and the adhesive side of the plastic flap in the first position to facilitate unsticking the plastic flap from the paper business card body so as to move the plastic flap toward the second position.

21. A business card according to claim 18, wherein the plastic flap is substantially transparent.

22. A business card according to claim 18, wherein the plastic flap is more flexible than the paper business card body.

23. A business card according to claim 18, wherein the plastic flap comprises a hinge, wherein the hinge is located adjacent the paper business card body.

24. A business card according to claim 23, wherein the hinge rotates approximately 360°.

25. A business card according to claim 23, wherein the hinge is more flexible than the remainder of the plastic flap.

26. A business card according to claim 23, wherein there is no adhesive on the hinge.

27. A business card according to claim 23, wherein the hinge has a height greater than the thicknesses of the paper business card body and also greater than the thickness of any other portion of the plastic flap.

28. A card comprising:

indicia of business information on at least one side of the card; and a means for enabling the card to be converted from an adhesive configuration to a non-adhesive configuration and vice versa.

29. A method of using a selectively adhesive business card, the method comprising:

storing the business card in a non-adhesive form such that an adhesive flap of the business card is folded down against and adheres to a portion of the business card;

unsticking the flap from the portion of the business card;

sticking the adhesive flap to another object to thereby adhere the business card to said another object so as to reveal indicia on a front side of the business card;

turning the business card over 180° while the adhesive flap remains adhered to said another object so that the business card lies flat against said another object to reveal indicia on a back side of the business card;

removing the adhesive flap from said another object; and re-sticking the adhesive flap to the portion of the business card to thereby return the business card to the non-adhesive form.

* * * * *